United States Patent [19]

Johnson

[11] 3,974,905

[45] Aug. 17, 1976

[54] KEY ARM MECHANISM

[75] Inventor: Wendell C. Johnson, Topanga, Calif.

[73] Assignee: Xerox Corporation, Stamford, Conn.

[22] Filed: Sept. 23, 1974

[21] Appl. No.: 508,484

[52] U.S. Cl. ..... 197/98; 197/17; 235/145 A

[51] Int. Cl.[2] ..... B41J 7/92

[58] Field of Search ..... 197/17, 33, 98, 106; 235/145, 146; 84/433; 200/5 R

[56] References Cited

UNITED STATES PATENTS

| | | | |
|---|---|---|---|
| 904,201 | 11/1908 | Harting | 197/33 |
| 950,029 | 2/1910 | Roberts | 197/33 |
| 1,040,232 | 10/1912 | Mecera | 84/433 X |
| 1,234,814 | 7/1917 | Standridge | 84/433 X |
| 2,074,051 | 3/1937 | Fitch | 197/98 X |
| 2,169,348 | 8/1939 | Utz | 197/33 |
| 2,209,227 | 7/1940 | Helmond | 197/33 |
| 2,240,477 | 5/1941 | Bauder | 197/33 |
| 3,014,569 | 12/1961 | Palmer | 197/98 X |
| 3,152,759 | 10/1964 | May | 197/98 X |
| 3,302,877 | 2/1967 | Stuiber et al. | 235/145 R |
| 3,502,824 | 3/1970 | Bonacquisti | 200/5 R X |
| 3,633,723 | 1/1972 | Kosters | 197/17 |
| 3,767,022 | 10/1973 | Olson | 197/98 X |
| 3,789,970 | 2/1974 | Costa | 197/17 |
| 3,814,228 | 6/1974 | Blum | 197/17 X |

OTHER PUBLICATIONS

"Unitary Plastic Key Lever System", IBM Tech. Discl. Bull., Anglin et al, vol. 10, No. 12, May 1968.

"Single Action Keyboard Device", IBM Tech. Discl. Bull., Jennings, vol. 11, No. 11, Apr. 1969.

*Primary Examiner*—Edgar S. Burr
*Assistant Examiner*—Paul J. Hirsch
*Attorney, Agent, or Firm*—J. E. Beck; T. J. Anderson; Leonard Zalman

[57] ABSTRACT

A key arm mechanism for keys of a typewriter or data entry device in which a uniform spring rate is achieved by varying the cross-sectional area of the key arms as a direct relation to the distance of the key support posts from a cantilever point. The entire key arm mechanism is formed of a unitary molded material. In one embodiment, the cross-sectional area of each key arm is uniform from the cantilever point to its associated key support post. In another embodiment, the cross-sectional area of each key arm decreases linearly from the cantilever point to its associated key support post. Uniform initial preload tension can be applied to the key arms by a slotted member which engages the ends of the key arms remote from the cantilever points. Non-uniform preload tension can be achieved by varying the height of some slots of the slotted member or by varying the height of the key arms at the ends thereof remote from the cantilever points. Adjustment of the preload tension can be achieved by an eccentric positioned adjacent the cantilever points.

3 Claims, 10 Drawing Figures

KEY ARM MECHANISM

BACKGROUND OF THE INVENTION

In devices such as keyboards, it is desirable that all or substantially all of the keys have the same spring rate, that is, that substantially all of the keys require the application of the same force to achieve a specified displacement of the keys. This uniformity of spring rate is comfortable for the key operator and tends to produce uniform print quality when the device is used for direct printing and to produce reliable data input when the device is used as a data entry terminal for a computer or the like. In addition to uniform spring rate, it is desirable that depression of the keys and their return to the normal position be achieved with a minimum of noise.

Generally, control of spring rate has heretofore been achieved by components that are attached between the key arms and the keyboard supporting structure. In U.S. Pat. No. 3,609,757, a retaining spring is used to regulate spring rate with compression of the spring returning the key arm to its normal position following depression. In U.S. Pat. No. 1,974,307, spring tension is utilized to achieve key spring rate control. The use of springs and other mechanical members to adjust spring rate and to achieve key return is not desirable because of the cost, noise and complexity of such arrangements. Although the unitary molded switching device described in U.S. Pat. No. 3,767,022, may obviate some switching-related noise problems, such devices still require independent means for returning the switch elements to their normal, or rest, position when the operator releases the depressed switching key.

OBJECTS OF THE INVENTION

An object of the present invention is to provide a key arm mechanism for a keyboard that provides a uniform spring rate.

A further object of the present invention is to provide a key arm mechanism for a keyboard that is inexpensive to produce.

A further object of the present invention is to provide a key arm mechanism for a keyboard that is quiet.

A still further object of the present invention is to provide a key arm arrangement for a keyboard in which initial bias or preload force of the key arms can be regulated easily.

SUMMARY OF THE INVENTION

In accordance with the invention, the foregoing objects are provided by a key arm mechanism in which the cross-sectional area of each key arm varies in accordance with the distance of the key arm's key support post from the key arm cantilever or "root" point. As the distance increases, the cross-sectional area increases. The thickness of all the key arms is uniform from the key arm support posts to a slotted key arm end bar, which bar is at the end of the key arms remote from the cantilever points. Initial key arm bias or preload force control is achieved by varying the height of the portion of the key arm that fits within the slots of the key arm end bar or by varying the height of the slots of the key arm bar.

In one embodiment of the invention, the cross-sectional area of each key arm is substantially uniform from the cantilever point to the key support post. The cross-sectional area is different for different key arms, with the cross-sectional area of each arm depending upon the position of the key support post from the key arm cantilever point. In another embodiment of the invention, the cross-sectional area of the key arm is tapered linearly from the cantilever point to the key support posts. The initial cross-sectional area of each of the key arms of the latter embodiment also varies according to the distance of the key support post of that arm from the cantilever point; however, the rate of taper is uniform for all key arms.

The foregoing objects and other objects of the present invention will be readily apparent from a reading of the following specification in conjunction with the attached drawings in which.

Figure 1:
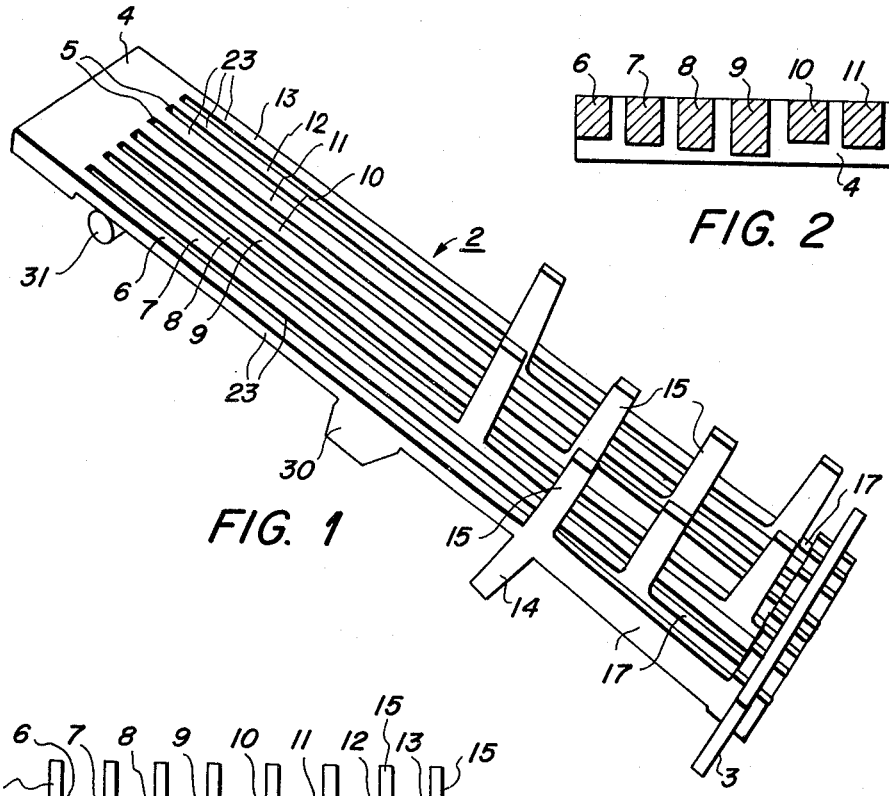
FIG. 1 is a perspective view of one embodiment of the key arm mechanism of the present invention.
Figure 5A:
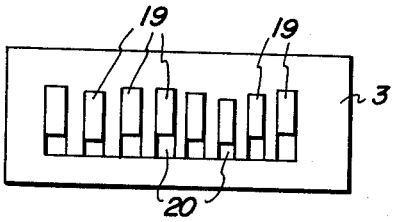
FIG. 5 is an end view of the mechanism of FIG. 1.

FIG. 5*a* is an end view of another embodiment of the mechanism of FIG. 1.

Figure 6:
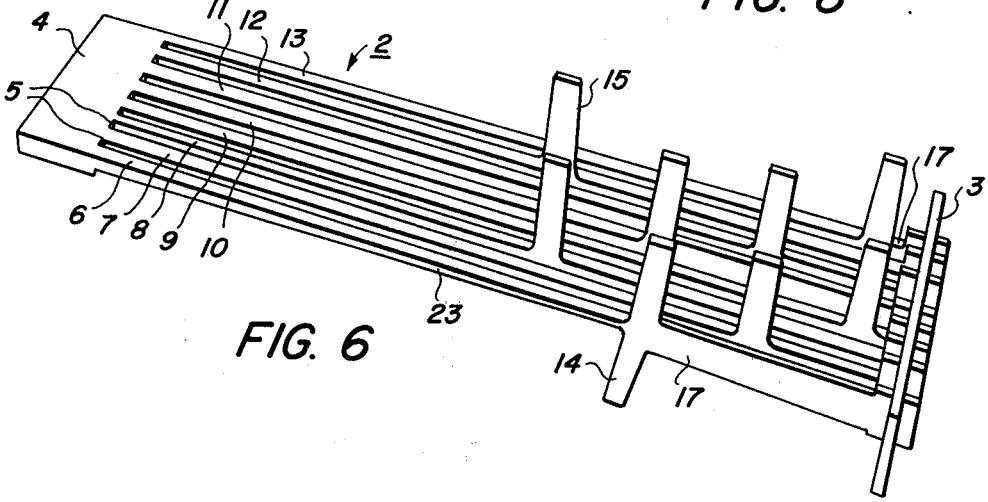

FIG. 6 is a perspective view of a second embodiment of the key arm mechanism of the present invention.

Figure 7:
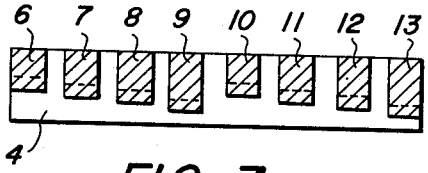
Figure 9:
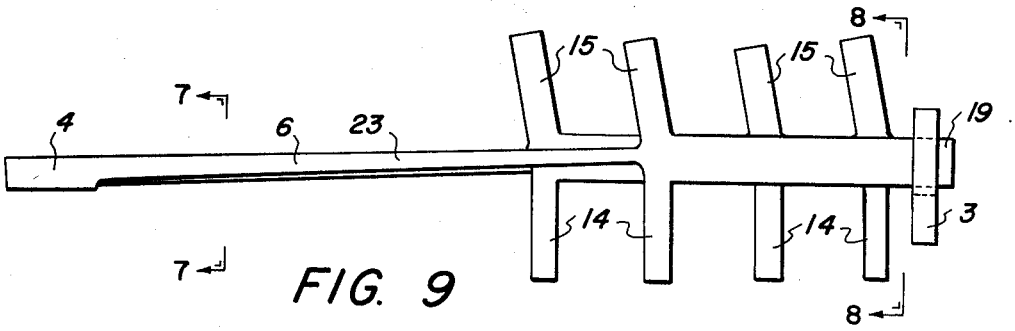

FIG. 7 is an end view of the mechanism of FIG. 9 taken along line 7—7.

Figure 8:
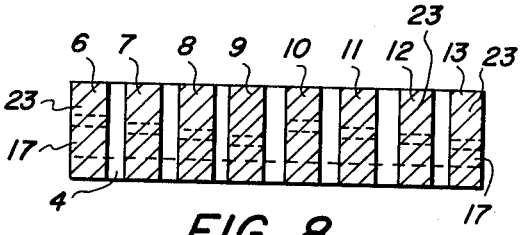

FIG. 8 is an end view of the mechanism of FIG. 9 taken along line 8—8.

FIG. 9 is a side view of the mechanism of FIG. 6.

DESCRIPTION OF THE INVENTION

Referring now to the drawings, there is shown in FIGS. 1, 2, 3, and 4 one embodiment of a key arm mechanism 2 and slotted key arm end bar 3 in accordance with the invention. The mechanism 2 is a unitary molded structure which may be formed from any suitable material, such as plastic, and the slotted end bar 3 may be formed of metal or plastic. The unitary key arm mechanism 2 includes a permanently anchored primary support section 4 of a generally rectangular configuration having a plurality of key arms 6 through 13 emanating from the length thereof. Each of the key arms includes a switch actuating stem 14 and a key support post 15 aligned with the switch actuating stems 14. The displacement of the key support posts 15 from the support section 4 varies in order to allow all of the keys (not shown) of, for example, a keyboard, to be mounted on the support posts 15. Since a conventional keyboard has four rows of keys, the displacement of each group of four key support posts will be different with the displacement repeating thereafter. For example, the displacement of support posts 15 is different for key arms 6, 7, 8, and 9, with arms 6 and 10, 7 and 11, 8 and 12, and 9 and 13 having the same key support post displacement. Each of the switch actuating stems 14 is substantially perpendicular to its associated key arm whereas each of the key support posts 15 forms an angle of about 75 to 85 degrees with its associated key arm in order to provide the key with a tilt or orientation most desirable for the keyboard operator. The keys may be molded as an integral part of the mechanism 2. The key stems, when depressed, as a result of a downward pressure on one or more of the keys effects a switching action by contacting a switching device (not shown) such as those described in concurrently filed U.S. Pat. applications Ser. Nos. 508,480; and 508,485, entitled SWITCHING DEVICE AND KEYBOARD, DEFORMED, INTEGRAL SWITCHING DEVICE, and ARCH SHAPED SNAP-TYPE SWITCH CONTACT, respectively, all having the same inventor as the subject application.

Figure 3:
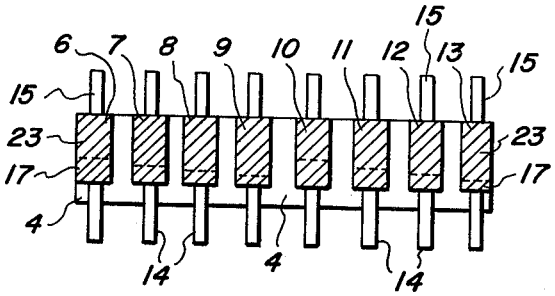
FIG. 3 is an end view of the mechanism of FIG. 4 taken along line 3—3.
Figure 4:
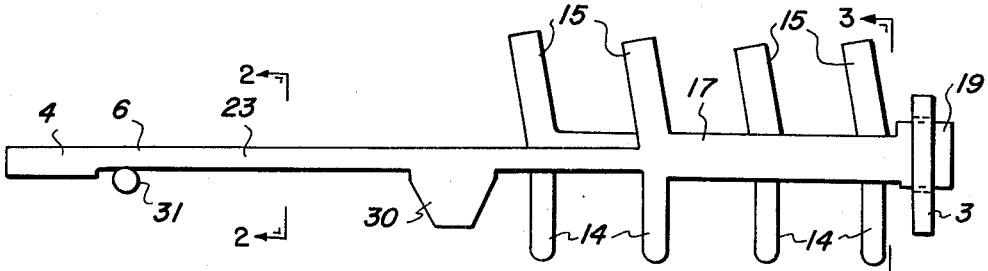
FIG. 4 is a side view of the mechanism of FIG. 1.

As shown clearly in FIGS. 1 and 3, the cross-sectional area of all of the key arms 6–13 is substantially the same over the portion 17 thereof from the key support posts 15 to the key arm ends 19. The ends 19 of the key arms are slightly larger than the portions 17 and fit snugly between the sidewalls of the slots 20 of the key arm end bar or comb 3 which is immovably anchored to the keyboard support structure (not shown). The slots 20 are vertically elongated in order to allow for downward movement of the key arms when a force is applied to posts 15.

Figure 2:
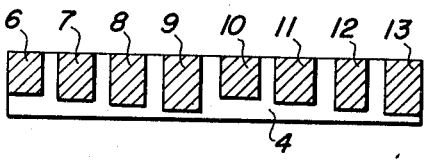
FIG. 2 is an end view of the mechanism of FIG. 4 taken along line 2—2.

As clearly shown in FIG. 2, key arms in which the displacement of the key support posts 15 from the junction points 5 with the support section 4 is different will have different cross-sectional areas over these displacements which are referenced as sections 23. The magnitude of the cross-sectional area of section 23 of any key arm is constant and a direct relationship to the distance of the key support post of that key arm from the junction point or cantilever point 5 of support member 4. That is, the greater the distance of the key support post to the point 5 of support member 4, the greater the cross-sectional area of the section 23 of that key arm. Key arms in which the displacement or length of sections 23 is the same, such as key arms 6 and 10, 7 and 11, 8 and 12, and 9 and 13, would have the same cross-sectional area over the sections 23. Specifically, in the device shown in FIGS. 1 and 2, section 23 of key arms 6 and 10 would have a smaller cross-sectional area than the sections 23 of key arms 7 and 11, with the cross-sectional area of sections 23 of key arms 8 and 12 being larger than sections 23 of key arms 7 and 11 but smaller than the cross-sectional area of sections 23 of key arms 9 and 13.

Figure 5:
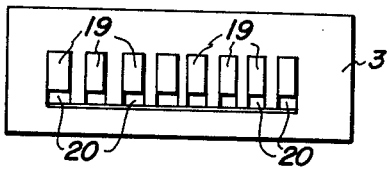

In use, the support member 4 is held firmly in place and the ends 19 of the key arms 6–13 are fitted snugly between the sidewalls of the slots 20 of the key arm end bar 3 which is also firmly affixed. As previously noted, and as shown in FIG. 5, the height of the slots 20 is greater than the height of the ends 19 to allow for downward movement of the key arms as they rotate about the cantilever points 5. The bar 3 is positioned vertically such that there is a slight uniform downward bias or preload force, for example, ten grams on the key arms. That is, the bar 3 is positioned such that the force exerted on the top surface of ends 19 is sufficient to bend arms 6–13 slightly downward from the position they would occupy if unrestrained. The height of the upper edge of the slots 20 may be lowered slightly, or the bar 3 may be moved vertically, to change the bias or preload force exerted at the cantilever points 5. The preload force can be varied by the operator by rotation of an eccentric 31, or equivalent device, located near the cantilever points 5.

As initially mentioned, it is desirable that all or substantially all of the key arms have the same spring rate. Such a uniformity of spring rate is achieved with the apparatus described and illustrated in FIGS. 1 through 5. Since the key arms are in fact a cantilever structure, downward pressure on a key support post 15 of a key arm will produce a moment force which is a product of the force applied to the post times the displacement of that post from the cantilever point 5 of that key arm, that is, the applied force times the length of section 23. If all of the key arms have the same cross-sectional area over section 23, as in the prior art, the moment force would be unequal since the distance to the key posts varies. By increasing the cross-sectional area of the sections 23 of the key arms as the distance from the key support post to cantilever points 5 increases, this inequality of moment force is obviated and a uniform spring rate for all keys is achieved. As noted, this uniformity of spring rate is more comfortable for the key operator and tends to produce print which has uniform character density and is of high quality.

The mechanism 2 has been shown to include only eight key arms and eight associated key support posts. Obviously, more key arms can be provided in the unitary structure 2 to provide for a full keyboard. Preferably, the spacing between key support posts having the same displacement from the cantilever points 5 would be about 2 cm, and the incremental difference in displacement of the support posts from the points 5 would be 2 cm, both in accordance with a conventional typewriter keyboard layout.

As mentioned, it is desirable that the key arm mechanism be quiet. By making the mechanism of plastic, the noise created by friction, by the travel of the end sections 19 in the slots 20, is reduced. To further reduce noise, the bar 3, which would normally be metal, may also be made of plastic, or the slots 20 may have a plastic coating on their walls. A further reduction in noise could be achieved by rounding the sides of the sections 19 or by having the sides of the slots 20 of bar 3 bowed inwardly; both modifications will reduce the area of contact between the sections 19 and the slots 20. Increased lateral stability may be achieved by having stabilizing members protruding from, or formed as an integral part of the key arms, with such stabilizing members, such as member 30 of FIG. 4, fitting into the slots of a lateral stabilizer plate (not shown) positioned beneath the mechanism 2.

With the structure described in FIG. 1, the height of the top of the slots 19 is uniform such that all keys have the same initial bias or preload force. In some instances it may be desirable to vary the preload force from key to key. This could be achieved by adjusting or varying the heights of the top edges of the slots 20 of bar 3, as shown in FIG. 5*a*, or by varying the height of the end sections 19 relative to each other.

Relating specifically to the mechanism of FIGS. 1 through 5, the cross-sectional area of section 23 of arms 6, 7, 8, and 9, respectively, may, for example, be 0.04 square mm, 0.0625 square mm, 0.09 square mm, and 1.225 square mm, respectively, with sections 23 of arms 10, 11, 12, and 13 having the same cross-sectional areas as sections 23 of arms 6, 7, 8, and 9, respectively. The length of arm sections 23 of arms 6, 7, 8 and 9 can be 7.5 cm, 9.2 cm, 11.2 cm, and 13 cm, respectively, with the overall length of all the arms from points 5 being 14.5 cm. The sections 17 would have a height of 6 mm and a width of 2.5 mm, with end sections 19 being 10 mm high and 2.5 mm wide. The key shafts and posts could both be 15 mm long.

The embodiment of the invention shown in FIG. 1 may cause high stresses at the cantilever points 5. To reduce these stresses, the key arms can have a taper such that the cross-sectional area of each key arm decreases from its cantilever point 5 to its key support post 15. FIG. 6 shows such an arrangement, with FIGS. 7 and 8 being end views of the mechanism of FIG. 6 taken along lines 7—7 and 8—8, respectively, and with parts corresponding to similar parts of the mechanism of FIG. 1 having the same reference numbers. In the mechanism of FIG. 6, the taper of each of the key support arms is linear, although a non-linear taper may also provide the desired uniformity of spring rate. As with the device of FIG. 1, the greater the distance of a key support post 15 from the cantilever point 5, the greater the initial cross-sectional area of the portion 23 of the key arm. As noted, the cross-sectional area of the portion 23 of each portion 23 decreases from support 4 at a linear rate, with the rate of decrease preferably being 1.5 square mm per mm of length of section 23. By way of example, the key arms 6, 7, 8, and 9 can have a cross-sectional area immediately adjacent the cantilever points 5 of 4 square mm, 6.25 square mm, 9.0 square mm, and 12.25 square mm, respectively, and cross-sectional areas immediately adjacent the key support posts 15 of 2.0 square mm, 4.0 square mm, 4.5 square mm, and 7.5 square mm, respectively.

Although the invention has been described with reference to specific embodiments thereof, various modifications can be made without departing from the scope of the invention. For example, cantilever points 5 can be made very thin so that the key arms act as hinges, and lockout means can be provided such that movement of the key arms can be frozen until an authorized party renders the lockout means ineffective.

I claim:

1. A unitary key arm mechanism for a key actuated device comprising a support section, a plurality of key arms emanating from said support section, each of said key arms having a key support post projecting therefrom such that each key arm supports a support post, the distance of some of said support posts from said support section being greater than the distance of other of said support posts from said support section and less than the distance of still other of said support posts from said support section, the cross-sectional areas of said key arms supporting said some of said support posts being both greater than the cross-sectional areas of said key arms supporting said other of said support posts and smaller than the cross-sectional area of said key arms supporting said still other of said support posts, said cross-sectional areas being measured for all key arms at a fixed distance from said support section and between said support section and the support post closest to said support section.

2. The key arm mechanism of claim 1 wherein said cross-sectional area of each of said key arms is constant throughout its length between said support section and its related support post.

3. The key arm mechanism of claim 1 wherein the cross-sectional areas of at least some of said key arms decreases at a linear rate from their value at said support section.

* * * * *